US010634441B2

(12) United States Patent
Fumia et al.

(10) Patent No.: US 10,634,441 B2
(45) Date of Patent: Apr. 28, 2020

(54) DIRECT ACTING BARREL RECOIL SPRING

(71) Applicant: American Classic Arms, LLC, Wayland, NY (US)

(72) Inventors: David Theodore Fumia, Rochester, NY (US); Ronald Herman Kohlstaedt, Wayland, NY (US)

(73) Assignee: American Classic Arms, LLC, Wayland, NY (US)

( * ) Notice: Subject to any disclaimer, the term of this patent is extended or adjusted under 35 U.S.C. 154(b) by 0 days.

(21) Appl. No.: 16/111,336

(22) Filed: Aug. 24, 2018

(65) Prior Publication Data

US 2019/0072346 A1 Mar. 7, 2019

Related U.S. Application Data

(63) Continuation of application No. 15/410,134, filed on Jan. 19, 2017, now Pat. No. 10,077,959.

(60) Provisional application No. 62/280,412, filed on Jan. 19, 2016.

(51) Int. Cl.

| | |
|---|---|
| ***F41A 9/23*** | (2006.01) |
| ***F41A 21/12*** | (2006.01) |
| ***F41A 21/28*** | (2006.01) |
| ***F41A 19/50*** | (2006.01) |
| ***F41A 9/24*** | (2006.01) |
| ***F41A 3/86*** | (2006.01) |
| ***F41A 21/36*** | (2006.01) |
| *F41C 3/00* | (2006.01) |

(52) U.S. Cl.

CPC ..... *F41A 9/23* (2013.01); *F41A 3/86* (2013.01); *F41A 9/24* (2013.01); *F41A 19/50* (2013.01); *F41A 21/12* (2013.01); *F41A 21/28* (2013.01); *F41A 21/36* (2013.01); *F41C 3/00* (2013.01)

(58) Field of Classification Search

CPC ..... F41A 9/23; F41A 9/24; F41A 3/86; F41A 19/50; F41A 21/12; F41A 21/28; F41A 21/36; F41C 3/00

USPC ..... 42/18

See application file for complete search history.

(56) References Cited

U.S. PATENT DOCUMENTS

| | | | | | |
|---|---|---|---|---|---|
| 2,522,192 | A * | 9/1950 | Porter | F41A 3/86 | 89/198 |
| 2,664,786 | A * | 1/1954 | Guisasola | F41A 5/04 | 89/163 |
| 3,491,650 | A * | 1/1970 | Rohr | F41A 3/78 | 89/194 |
| 3,682,040 | A * | 8/1972 | Roy | F41A 5/04 | 89/132 |
| 4,539,889 | A * | 9/1985 | Glock | F41A 5/04 | 89/147 |
| 5,309,815 | A * | 5/1994 | Moller | F41A 5/04 | 89/163 |
| 5,581,046 | A * | 12/1996 | Weldle | F41A 5/04 | 89/196 |
| 5,741,996 | A * | 4/1998 | Ruger | F41A 3/66 | 89/196 |

(Continued)

*Primary Examiner* — Samir Abdosh

(74) *Attorney, Agent, or Firm* — Brian B. Shaw, Esq.; Harter Secrest & Emery LLP

(57) ABSTRACT

The present disclosure presents a barrel assembly for a firearm. The barrel assembly includes a barrel having an internal bore and an external surface, and a recoil spring lug affixed to an outside surface of the barrel. The barrel assembly also includes a slide moveably mounted relative to the barrel, and a recoil spring biased on the recoil spring lug and the slide.

23 Claims, 7 Drawing Sheets

(56) References Cited

U.S. PATENT DOCUMENTS

| | | | | |
|---|---|---|---|---|
| 6,314,859 | B1 * | 11/2001 | Weichert | F41A 3/86 42/1.06 |
| 7,337,571 | B2 * | 3/2008 | McGarry | F41A 3/86 42/16 |
| 8,640,375 | B2 * | 2/2014 | Ketchum | F41A 11/00 42/108 |
| 2005/0257413 | A1 * | 11/2005 | Zimmermann | F41A 5/04 42/75.1 |
| 2006/0272192 | A1 * | 12/2006 | Zimmermann | F41A 5/04 42/7 |
| 2016/0146559 | A1 * | 5/2016 | Bantle | F41A 17/34 42/16 |

* cited by examiner

DIRECT ACTING BARREL RECOIL SPRING

BACKGROUND OF THE INVENTION

Field of the Invention

The present disclosure relates to a barrel assembly of a firearm. The present disclosure relates more particularly to a barrel assembly of a firearm with a recoil lug.

Description of Related Art

A firearm is a portable gun or barreled weapon that is capable of launching one or more projectiles often driven by the action of an explosive force. A semi-automatic, or self-loading firearm is one that performs all steps necessary to prepare it to discharge again after firing.

Some semi-automatic firearms use a recoil operation for loading, which is a type of locked-breech firearm action. It uses the energy from the combustion in the chamber acting directly on the bolt through the cartridge head, but in this case the firearm has a recriprocating barrel and breach assembly, combined with a bolt that locks to the breach. The breach remains locked as the bolt and barrel travel rearward together for some distance, allowing pressure in the chamber to drop to a safe level before the breech is opened.

BRIEF SUMMARY OF THE INVENTION

In view of the foregoing, it is an object of the present disclosure to provide a barrel assembly and a method of forming.

A first exemplary embodiment of the present disclosure provides a barrel assembly for a firearm. The barrel assembly includes a barrel having an internal bore and an external surface, and a recoil spring lug affixed to an outside surface of the barrel. The barrel assembly further includes a slide moveably mounted relative to the barrel, and a recoil spring biased on the recoil spring lug and the slide.

A second exemplary embodiment of the present disclosure provides a firearm. The firearm includes a frame, and a barrel connected to the frame, the barrel having a longitudinal axis and a radially projecting spring lug. The firearm further includes a slide slideably mounted relative to the frame and the barrel along the longitudinal axis, and a recoil spring extending between the spring lug and the slide.

A third exemplary embodiment of the present disclosure provides a method. The method includes forming a barrel having an internal bore and an external surface, and forming a recoil spring lug affixed to an outside surface of the barrel. The method further includes forming a slide moveably mounted relative to the barrel, and locating a recoil spring biased on the recoil spring lug and the slide.

The following will describe embodiments of the present disclosure, but it should be appreciated that the present disclosure is not limited to the described embodiments and various modifications of the invention are possible without departing from the basic principles. The scope of the present disclosure is therefore to be determined solely by the appended claims.

BRIEF DESCRIPTION OF THE SEVERAL VIEWS OF THE DRAWING(S)

DETAILED DESCRIPTION OF THE INVENTION

Embodiments of the present disclosure provide a barrel having a recoil spring lug affixed thereto operable such that a slide of a firearm against a recoil spring is biased against the recoil spring lug.

The term firearm includes guns, handguns, and pistols, wherein the motive energy can be from chemical or mechanical storage.

Figure 1:
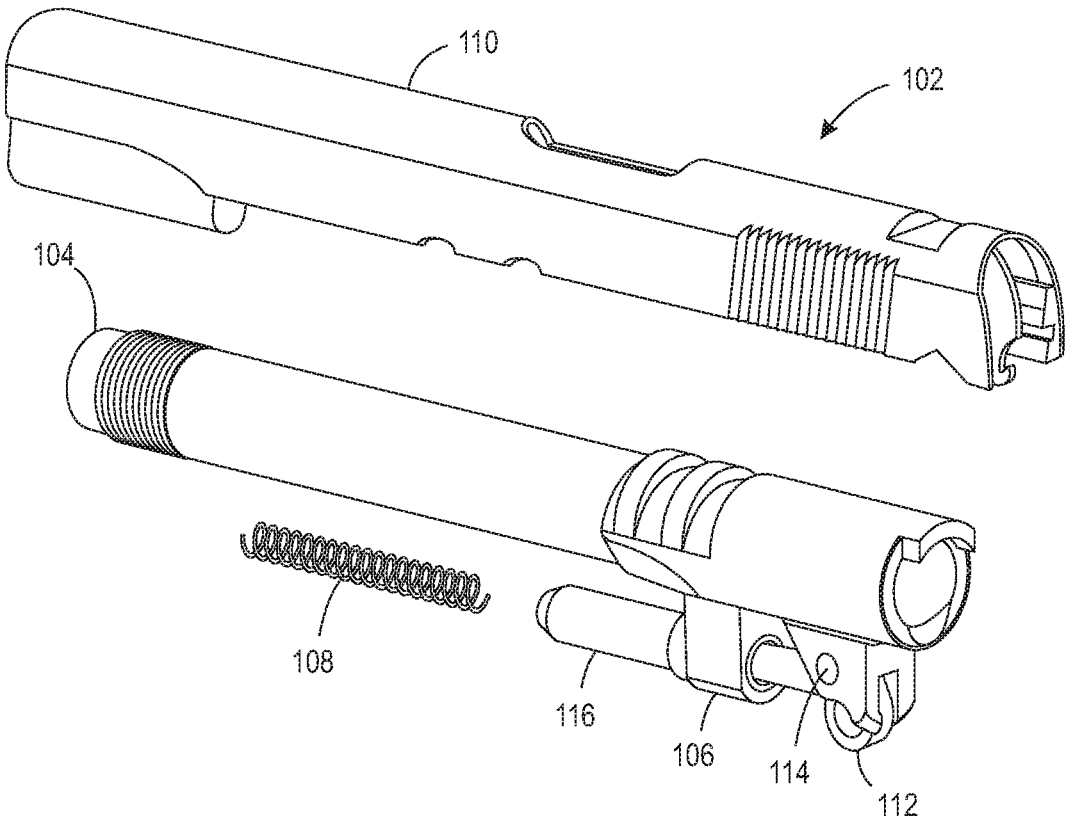
FIG. 1 is a side perspective view of an exemplary barrel assembly suitable for practicing exemplary embodiments of the present disclosure.

Referring to FIG. 1, shown is a side perspective view of an exemplary barrel assembly 102 suitable for practicing exemplary embodiments of this disclosure. Shown in FIG. 1 is barrel assembly 102 suitable for use with a firearm 100, such as a pistol or handgun. Barrel Assembly 102 includes a barrel 104, a recoil spring lug 106, a recoil spring 108, and a slide 110.

Exemplary embodiments of barrel assembly 102 are operable for use with any type of pistol, handgun or other related firearms. Barrel assembly 102 includes a barrel 104 which provides a hollow tube having a long axis through which a deflagration or rapid expansion of gases are released in order to propel a projectile out of the end at a high velocity. Exemplary embodiments of barrel 104 are made of metal, plastics, metal alloys, and/or aluminum alloys. Embodiments of barrel 104 are able to hold in expanding gas produced by propellants to ensure optimum muzzle velocity when a projectile is pushed out by expanding gases.

Embodiments of barrel 104 can have an interior surface that is smooth creating a circular cross sectional surface, rifled creating a pattern of ridges and grooves, or shaped creating a polygonal cross sectional surface.

Recoil Spring lug 106 is fixedly attached to the outside of barrel 104 adjacent to the barrel link 112 and barrel link pin 114. Recoil spring lug 106 extends radially from the outside surface of barrel 104 and is located near the rear of barrel 106 near barrel link 112. Recoil spring lug 106 includes a recoil spring guide 116 extending longitudinally from recoil spring lug 106 along the long axis of barrel 104. Recoil spring guide 116 can be removeably attached to recoil spring lug 106 such that recoil spring guide 116 can be attached to and removed from recoil spring lug 106 through any means such as screwing, clamping, or clasping. Recoil spring guide 116 can also be fixedly attached to recoil spring lug 106 such that it cannot be removed from recoil spring lug 106. Embodiments of recoil spring guide 116 are sized to allow recoil spring 108 to sit around recoil spring guide 116 such that recoil spring guide 116 extends within recoil spring 108 along its long axis. Recoil spring guide 116 is thus operable to maintain a position of recoil spring 108 relative to barrel 104.

Slide 110 is a part of a firearm 100 that moves during the operating cycle of the firearm 100. Slide 110 is operable to moveable attach to a frame of firearm 100 over barrel 104 such that slide 110 can slide along the long axis of barrel 104 and the long axis of slide 110. Movement of slide 110 relative to barrel 104 along their long axis includes compression of recoil spring 108 when slide 110 is moved toward the rear of barrel 104 where recoil spring lug 106 is located. Likewise, movement of slide 110 relative to barrel 104 along their long axis includes extension of recoil spring 108 when slide 110 is moved toward the front of barrel 104 away from recoil spring lug 106.

In other words, recoil spring 108 is biased against recoil spring lug 106 and slide 110 such that operation of slide 110 (i.e., movement of slide 110 relative to barrel 104 and recoil spring lug 106) either compresses recoil spring 108 between slide 110 and recoil spring lug 106 or allows recoil spring 108 to extend or become uncompressed between slide 110 and recoil spring lug 106. In practice, due to recoil spring 108 and recoil spring lug 106 acting on slide 110, slide 110 is "spring-loaded" so that once it has moved to its rearmost position in a firing cycle, spring tension from recoil spring 108 bring or forces slide 110 back to the starting position and thus chambering a new cartridge into firearm 100 during the motion provided that the magazine is not empty.

Embodiments of slide 110, recoil spring 108 and recoil spring lug 106 are operable such that when slide 110 is forced back by recoil spring 108 three actions are performed: (1) the spent casing is ejected, (2) the hammer or striker is cocked for the next shot, and (3) another cartridge is loaded.

Figure 2:
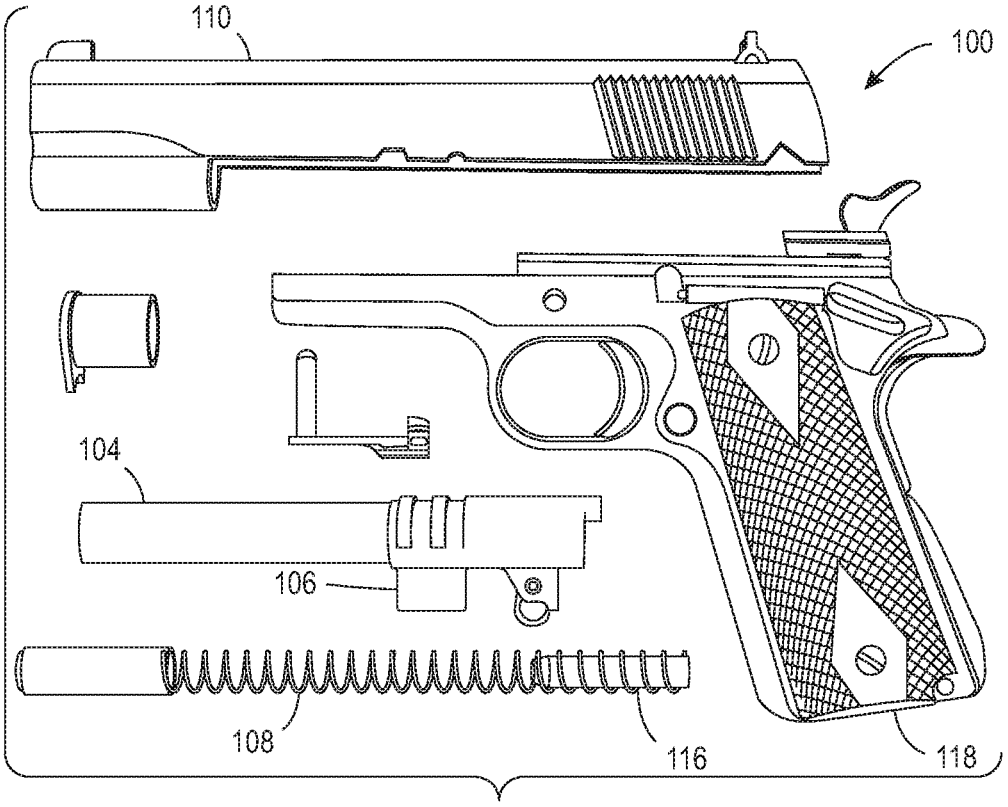
FIG. 2 is an exploded view of an exemplary firearm suitable for practicing exemplary embodiments of the present disclosure.

Referring to FIG. 2, presented is an exploded view of an exemplary firearm suitable for practicing exemplary embodiments of the present disclosure. Shown in FIG. 2 is firearm 100 with barrel 104, recoil spring lug 106, recoil spring 108, recoil spring guide 116, slide 110, and frame 118. Firearm 100 as depicted in FIG. 2 is a model M1911, however, it should be appreciated that exemplary embodiments of this disclosure are applicable to any firearm or pistol that includes a "spring-loaded" mechanism for returning the slide 110 back to its original position relative to the barrel 104 after firing. As is shown in FIG. 2, recoil spring guide 116 is removeable from recoil spring lug 106 and sits within recoil spring 108 extending down the long axis of recoil spring 108.

Figure 3:
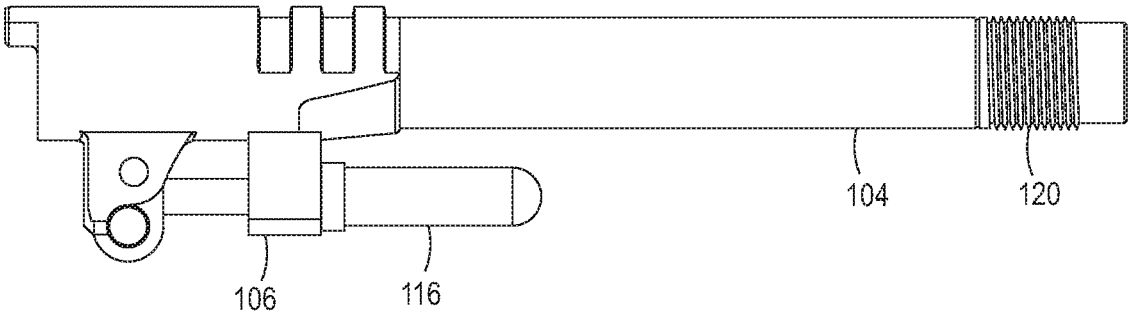
FIG. 3 is a side view of an exemplary barrel assembly suitable for practicing exemplary embodiments of the present disclosure.

Reference is now made to FIG. 3, which depicts a side view of an exemplary barrel assembly suitable for practicing exemplary embodiments of the present disclosure. Shown in FIG. 3 is barrel 104, recoil spring lug 106, and recoil spring guide 116. It should be noted that barrel 104 includes screw notches 120 for interaction with additional elements of firearm 100, however, embodiments of barrel 104 need not include screw notches 120.

Recoil spring guide 116 and recoil spring lug 106 provide a means for maintain recoil spring 108 (shown in FIG. 1 and FIG. 2) relative to barrel 104. Embodiments of recoil spring 108 thus are not biased against the frame 118 but are biased against an extension of barrel 104 (i.e., recoil spring lug 106) and slide 110.

Figure 4:
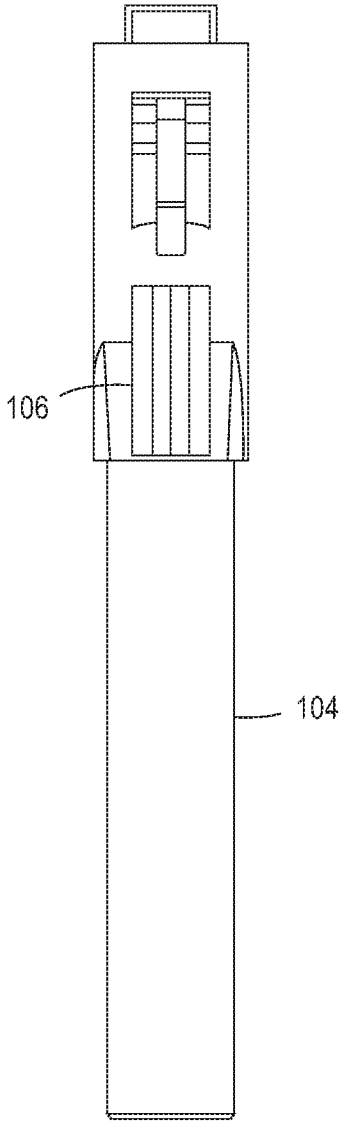
FIG. 4 is a bottom view of an exemplary barrel assembly suitable for practicing exemplary embodiments of the present disclosure.

Referring to FIG. 4, shown is a bottom view of an exemplary barrel assembly suitable for practicing exemplary embodiments of the present disclosure. Shown in FIG. 4 is barrel 104 and recoil spring lug 106. In the embodiment of barrel 104 illustrated in FIG. 4, recoil spring guide 116 is removeable and has been removed from recoil spring lug 106. Accordingly, FIG. 4 does not depict a recoil spring guide 116 affixed to recoil spring lug 106. However, it should be appreciated that embodiments of recoil spring lug 106 and recoil spring guide 116 provide for recoil spring guide 116 to be affixed to recoil spring lug 106 through any means including screwing, clasping, clamping, welding, or a combination thereof.

Figure 5:
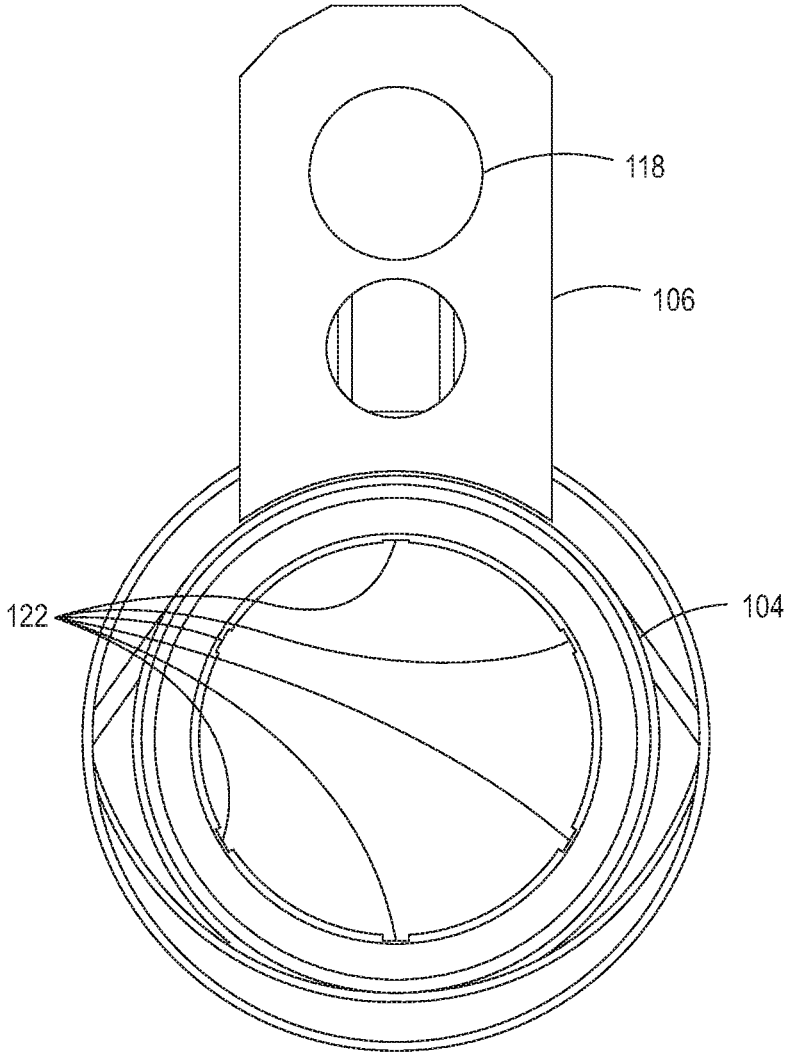
FIG. 5 is a front view of an exemplary barrel assembly suitable for practicing exemplary embodiments of the present disclosure.

Reference is now made to FIG. 5, which presents a front view of an exemplary barrel assembly suitable for practicing exemplary embodiments of the present disclosure. Shown in FIG. 5 is barrel 104, recoil spring lug 106, and recoil spring guide 118. As is evident from FIG. 5, barrel 104 includes a hollow tube with grooves 122 located along an interior surface of the hollow tube. In the embodiment shown in FIG. 5, grooves 122 extend through the long axis of barrel 104 along the interior surface in a spiral fashion. However, it should be appreciated that embodiments of grooves 122 can include any type of formation or size such that they aid in the expulsion and rotation of a projectile (e.g., a bullet) from barrel 104.

As can be seen from FIG. 5, barrel 104 and recoil spring guide 106 extend in symmetrical directions such that long axis and thus their cross section are aligned with one another. In practice, this allows slide 110 to move relative to barrel 104 and recoil spring guide 116 compressing or de-compressing recoil spring 108.

Figure 6:
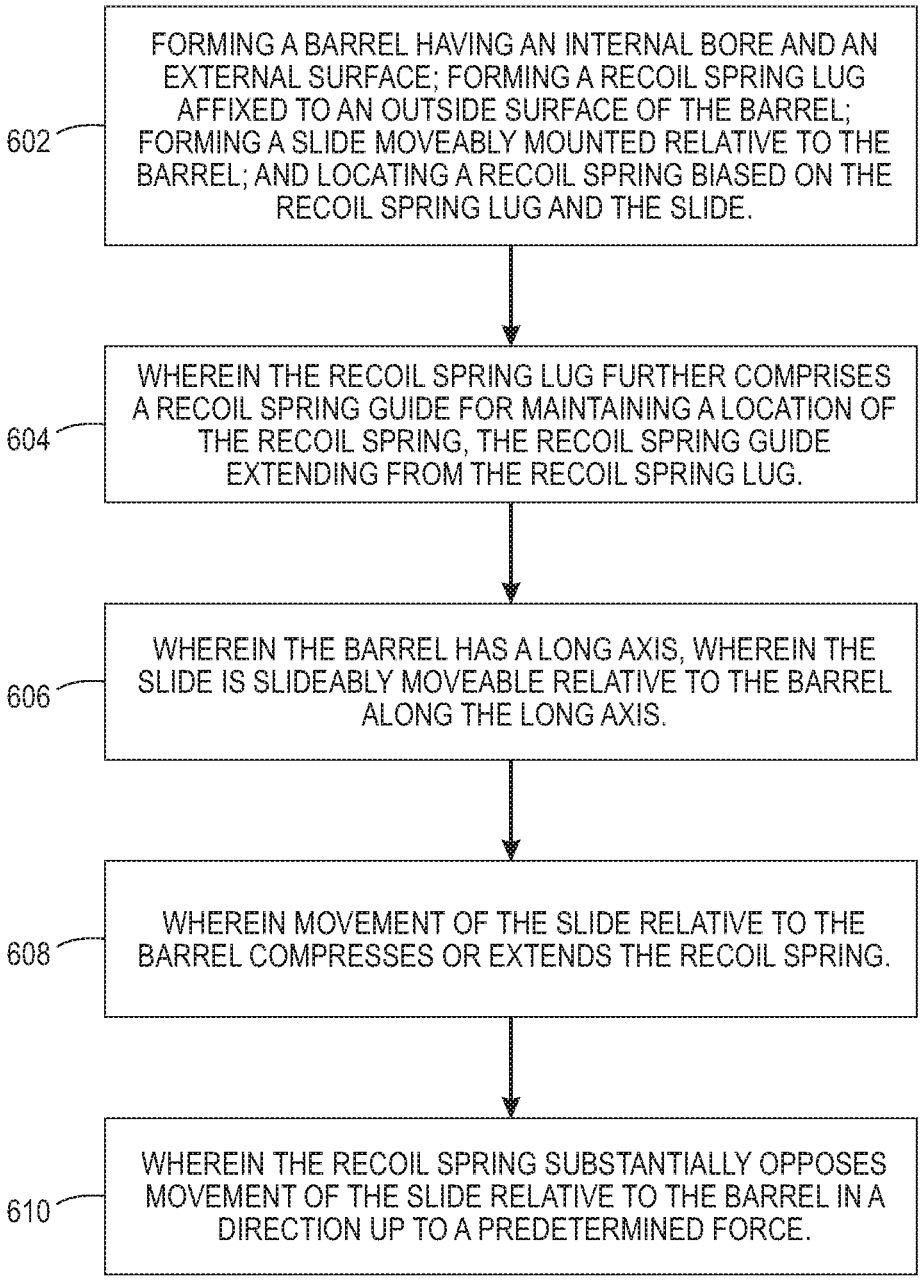
FIG. 6 is a logic flow diagram in accordance with a method and apparatus for performing exemplary embodiments of the present disclosure.

Referring to FIG. 6, presented is a logic flow diagram in accordance with a method and apparatus for performing exemplary embodiments of this disclosure. Block 602 presents forming a barrel having an internal bore and an external surface; forming a recoil spring lug affixed to an outside surface of the barrel; forming a slide moveably mounted relative to the barrel; and locating a recoil spring biased on the recoil spring lug and the slide. Then block 604 relates to wherein the recoil spring lug further comprises a recoil spring guide for maintaining a location of the recoil spring, the recoil spring guide extending from the recoil spring lug.

Some of the non-limiting implementations detailed above are also summarized at FIG. 6 following block 604. Block 606 specifies wherein the barrel has a long axis, wherein the slide is slideably moveable relative to the barrel along the long axis. Block 608 then states wherein movement of the slide relative to the barrel compresses or extends the recoil spring. Block 610 then indicates wherein the recoil spring substantially opposes movement of the slide relative to the barrel in a direction up to a predetermined force.

The logic flow diagram may be considered to illustrate the operation of method. The logic flow diagram may also be considered a specific manner in which components of a device are configured to cause that device to operate, whether such a device is a firearm, pistol, handgun, barrel, or one or more components thereof.

Figure 7:
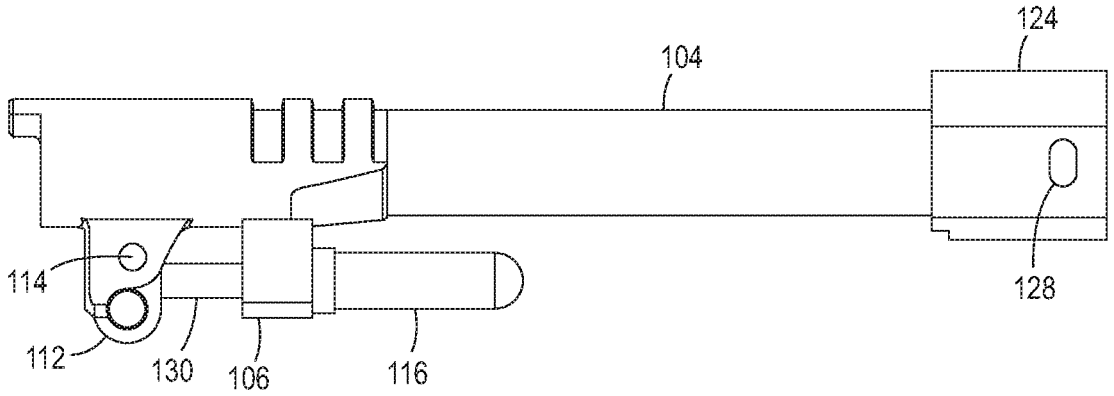
FIG. 7 is a side view of another exemplary barrel assembly suitable for practicing exemplary embodiments of the present disclosure.

Referring to FIG. 7, shown is a side view of another exemplary barrel suitable for practicing exemplary embodiments of the present disclosure. Shown in FIG. 7 is barrel 104, recoil spring lug 106, recoil spring guide 116, and muzzle brake 124. Embodiments of muzzle brake 124 are operably sized to slideably interact around an outside surface at the end of barrel 104. The muzzle brake 124 is operable to vent escaping gases during firing to reduce the recoil felt by a user when firing the firearm. Embodiments of muzzle brake 124 include one or multiple vents 128, which provide a passage to the hollow center of muzzle brake 124 for gases to pass or escape through.

Also, shown in FIG. 7 is plunger 130. Plunger 130 is moveably attached to recoil spring lug 106 such that plunger 130 can be compressed into or toward recoil spring lug 106 (e.g., into a hole in recoil spring lug 106). Plunger 130 includes an internal spring biased against recoil spring lug 106 urging plunger 130 into an expanded position as illustrated in FIG. 7. Plunger 130 is sized such that extends from recoil spring lug 106 and is biased against barrel link 112.

Embodiments of plunger 130 and barrel link 112 provide that plunger 130 maintains barrel link 112 in a down position as depicted in FIG. 7. However, upon firing, barrel link 112 can operably rotate towards plunger 130 about barrel link pin 114 thereby compressing plunger 130 into recoil spring lug 106. Then when the firearm is placed back into a firing ready position, barrel link 112 is forced back in the down position as depicted in FIG. 7 by plunger 130 and plunger 130 expands toward barrel link 112 to maintain barrel link 112 in the down position. Accordingly, embodiments of plunger 130 aid in maintaining barrel link 112 in a down position, but allow barrel link 112 to rotate during firing.

Figure 8:
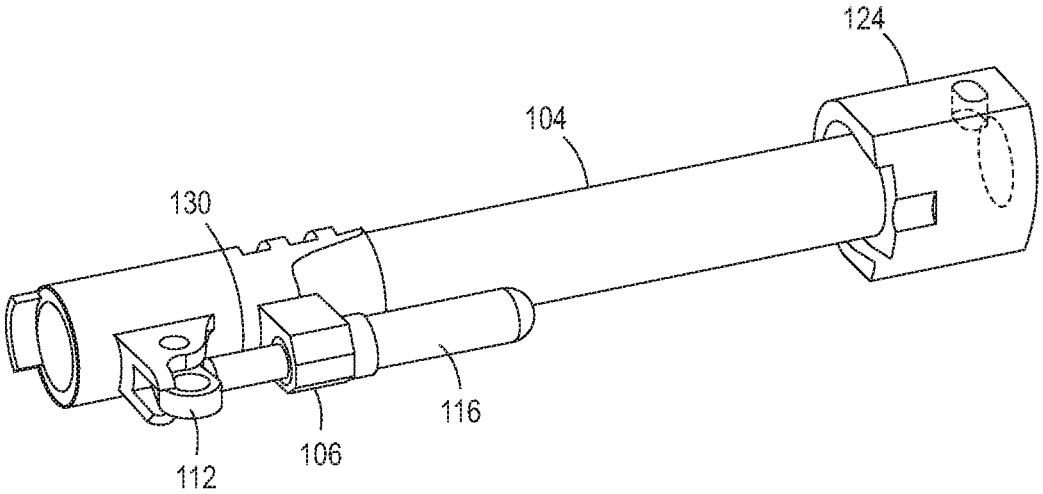
FIG. 8 is a bottom perspective view of another exemplary barrel assembly suitable for practicing exemplary embodiments of the present disclosure.

Reference is now made to FIG. 8, which depicts a bottom perspective view of another exemplary barrel assembly suitable for practicing exemplary embodiments of the present disclosure. Shown in FIG. 8 is a barrel 104, recoil spring lug 106, recoil spring guide 116, muzzle brake 124, plunger 130, and barrel link 112. As is evident, recoil spring lug 106 is fixed attached to barrel 104 and extends radially from the outside surface of barrel 104. Additionally, recoil spring guide 116 extends from recoil spring lug 106 parallel to the long axis of barrel 104 and is sized to interact and maintain a recoil spring.

Figure 9:
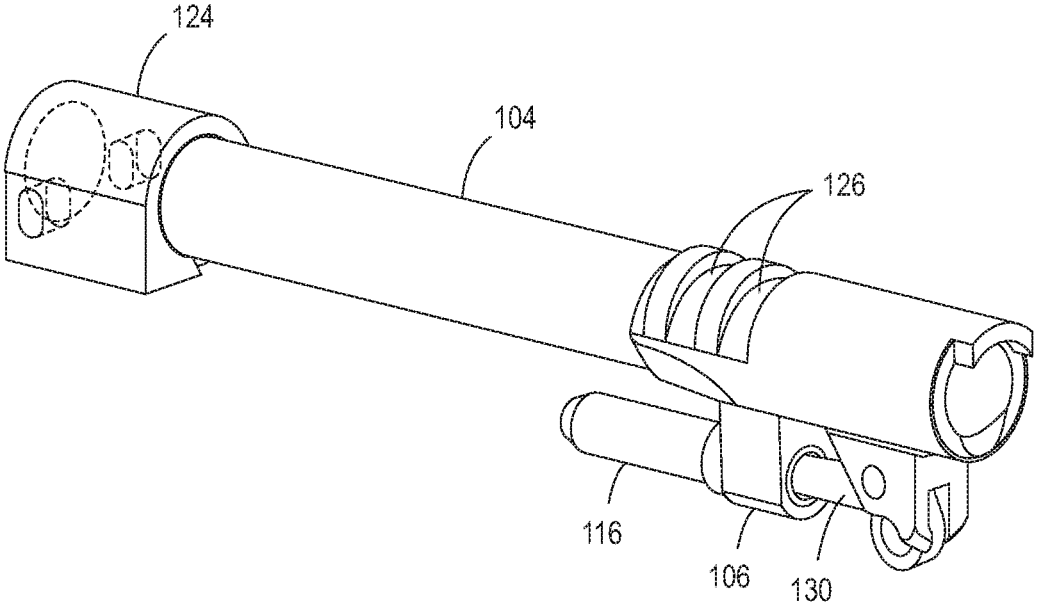
FIG. 9 is a top perspective view of another exemplary barrel assembly suitable for practicing exemplary embodiments of the present disclosure.

Referring to FIG. 9, shown is a top perspective view of another exemplary barrel assembly suitable for practicing exemplary embodiments of the present disclosure. Shown in FIG. 9 is barrel 104, recoil spring lug 106, recoil spring guide 116, muzzle brake 124, and plunger 130. Also shown in FIG. 9 are channels 126 located along a portion of the top of barrel 104 extending around a portion of the circumference of barrel 104 perpendicular to the long axis of barrel 104. Embodiments of channels 126 are sized to interact with a slide 110. It should be appreciated that embodiments of barrel 104 need not include channels 126 or may include additional channels 126 located on different portions of barrel 104 that can aid in recoil of firearm 100 after firing.

Embodiments of the present invention have been described in detail with particular reference to particular embodiments, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

The invention claimed is:

1. A barrel assembly for a firearm, the barrel assembly comprising:

a barrel having an internal bore and an external surface;

a recoil spring lug affixed to an outside surface of the barrel, the recoil spring lug including a hollow portion;

a slide moveably mounted relative to the barrel;

a recoil spring guide affixed to the recoil spring lug and extending from the recoil spring lug; and a recoil spring biased on the recoil spring guide and the slide for maintaining a location of the recoil spring.

2. The barrel assembly according to claim 1, wherein the recoil spring guide includes a first end and a second end, the first end being a tapered end.

3. The barrel assembly according to claim 2, wherein a cross-section of the second end of the recoil spring guide is greater than a cross-section of the first end of the recoil spring guide, the second end of the recoil spring guide being configured to be biased against the recoil spring.

4. The barrel assembly according to claim 1, wherein the recoil spring guide includes a hollow portion.

5. The barrel assembly according to claim 4, further comprising:

a barrel link affixed to the outside surface of the barrel;

a plunger spring positioned within the hollow portion of the recoil spring guide; and a plunger movably positioned within the hollow portion of the recoil spring guide and biased between the plunger spring and the barrel link.

6. The barrel assembly according to claim 1, wherein the barrel has a long axis, wherein the slide is slideably moveable relative to the barrel along the long axis.

7. The barrel assembly according to claim 1, wherein movement of the slide relative to the barrel compresses or extends the recoil spring.

8. The barrel assembly according to claim 1, wherein the recoil spring substantially opposes movement of the slide relative to the barrel in a direction up to a predetermined force.

9. A firearm comprising:

a frame;

a barrel connected to the frame, the barrel having a longitudinal axis and a radially projecting spring lug, the spring lug including a hollow portion;

a slide slideably mounted relative to the frame and the barrel along the longitudinal axis;

a spring guide affixed to the spring lug and extending from the spring lug; and a recoil spring biased on the spring guide and the slide for maintaining a location of the recoil spring.

10. The firearm according to claim 9, wherein the spring guide includes a first end and a second end, the first end being a tapered end.

11. The firearm according to claim 10, wherein a cross-section of the second end of the spring guide is greater than a cross-section of the first end of the spring guide, the second end of the spring guide being configured to be biased against the recoil spring.

12. The firearm according to claim 9, wherein the recoil spring substantially opposes movement of the slide relative to the barrel in a given direction.

13. The firearm according to claim 9, wherein the recoil spring is not biased against the frame.

14. The firearm according to claim 9, wherein the spring guide includes a hollow portion.

15. The firearm according to claim 14, further comprising:

a barrel link affixed to the outside surface of the barrel;

a plunger spring positioned within the hollow portion of the spring guide; and a plunger movably positioned within the hollow portion of the spring guide and biased between the plunger spring and the barrel link.

16. A method comprising:

forming a barrel having an internal bore and an external surface;

forming a recoil spring lug affixed to an outside surface of the barrel, the recoil spring lug including a hollow portion;

forming a slide moveably mounted relative to the barrel;

forming a recoil spring guide affixed to the recoil spring lug and extending from the recoil spring lug; and locating a recoil spring biased on the recoil spring guide and the slide for maintaining a location of the recoil spring.

17. The method according to claim 16, wherein the recoil spring guide includes a first end and a second end, the first end being a tapered end.

18. The method according to claim 17, wherein a cross-section of the second end of the recoil spring guide is greater than a cross-section of the first end of the recoil spring guide, the second end of the recoil spring guide being configured to be biased against the recoil spring.

19. The method according to claim 16, wherein the recoil spring guide includes a hollow portion.

20. The method according to claim 19, further comprising:

forming a barrel link affixed to the outside surface of the barrel;

providing a plunger spring positioned within the hollow portion of the recoil spring guide; and providing a plunger movably positioned within the hollow portion of the recoil spring guide and biased between the plunger spring and the barrel link.

21. The method according to claim 16, wherein the barrel has a long axis, wherein the slide is slideably moveable relative to the barrel along the long axis.

22. The method according to claim 16, wherein movement of the slide relative to the barrel compresses or extends the recoil spring.

23. The method according to claim 16, wherein the recoil spring substantially opposes movement of the slide relative to the barrel in a direction up to a predetermined force.

* * * * *